US005547387A

United States Patent [19]

Kobayashi

[11] Patent Number: 5,547,387

[45] Date of Patent: Aug. 20, 1996

[54] JOINT CONSTRUCTION FOR IGNITION SYSTEM

[75] Inventor: Yoshinao Kobayashi, Yokkaichi, Japan

[73] Assignee: Sumitomo Wiring Systems, Ltd., Yokkaichi, Japan

[21] Appl. No.: 281,748

[22] Filed: Jul. 28, 1994

[30] Foreign Application Priority Data

Aug. 5, 1993 [JP] Japan ..... 5-194665
Aug. 31, 1993 [JP] Japan ..... 5-216417

[51] Int. Cl.[6] ..... H01R 13/52

[52] U.S. Cl. ..... 439/125

[58] Field of Search ..... 439/125–128

[56] References Cited

U.S. PATENT DOCUMENTS

| | | | |
|---|---|---|---|
| 3,223,963 | 12/1965 | Rarey et al. . | |
| 3,246,284 | 4/1966 | Farison . | |
| 4,906,202 | 3/1990 | Germ | 439/125 |
| 4,997,380 | 3/1991 | Etienne et al. | 439/127 |
| 5,195,904 | 3/1993 | Cyvoct | 439/349 |
| 5,283,499 | 2/1994 | Adam et al. | 313/135 |
| 5,333,592 | 8/1994 | Benedikt et al. | 123/634 |
| 5,340,323 | 8/1994 | Imanishi et al. | 439/125 |
| 5,382,170 | 1/1995 | Imanishi | 439/127 |

FOREIGN PATENT DOCUMENTS

| | | |
|---|---|---|
| 0340083 | 11/1989 | European Pat. Off. . |
| 0433870 | 6/1991 | European Pat. Off. . |
| 0491626 | 6/1992 | European Pat. Off. . |
| 2745313 | 9/1978 | Germany . |
| 6-33863 | 2/1984 | Japan . |
| 64-8580 | 1/1989 | Japan . |
| 1576926 | 10/1980 | United Kingdom . |
| 2241739 | 9/1991 | United Kingdom . |
| 9208259 | 5/1992 | WIPO . |
| 9309345 | 5/1993 | WIPO . |

*Primary Examiner*—Gary F. Paumen
*Attorney, Agent, or Firm*—Greenblum & Bernstein P.L.C.

[57] ABSTRACT

A joint construction between a rodlike high-voltage terminal provided at a distal end of an ignition coil or an ignition cable and a tubular electrical conductor in an ignition system, in which the high-voltage terminal is fitted into the electrical conductor so as to be connected to a spark plug through the electrical conductor, comprising: the high-voltage terminal being formed, on its outer periphery, with a recess; the electrical conductor being formed with a through-hole confronting the recess; a ring which has a boss and is fitted around the electrical conductor such that the boss is brought into engagement with the recess of the high-voltage terminal via the thorough-hole of the electrical conductor; an insulating sleeve which is fitted around the electrical conductor and the ring and has an inside diameter for regulating not only radial expansion of the ring but separation of the high-voltage terminal from the electrical conductor; and a locking member for detachably locking the insulating sleeve to the ignition coil or the ignition cable.

8 Claims, 9 Drawing Sheets

19
19a
19b
19c
27b
22
21a
24a
21
27d
27c
27
22a
27a
22b
21b
24
B
C
A
27a
22
27c
27

JOINT CONSTRUCTION FOR IGNITION SYSTEM

BACKGROUND OF THE INVENTION

The present invention generally relates to a joint construction for an ignition system and more particularly, to a joint construction between a rodlike high-voltage terminal provided at a distal end of an ignition coil or an ignition cable of an internal combustion engine and a tubular electrical conductor, in which the high-voltage terminal is connected to a spark plug through the electrical conductor.

Japanese Utility Model Laid-Open Publication No. 64-8580 (1989) discloses an ignition system for connecting an ignition coil and a spark plug through an electrical conductor as shown in FIG. 1. In FIG. 1, an insulator 4 is mounted in a hole 3 formed on a cylinder head 2 of an engine 1 and an electrical conductor 5 is fitted into a bore of the insulator 4. A terminal 6 provided at an upper portion of the electrical conductor 5 is urged by a spring 7 so as to be brought into contact with a high-voltage terminal 9 of an ignition coil 8 inserted into inserted into an upper portion of the insulator 4. Meanwhile, a terminal 10 provided at a lower portion of the electrical conductor 5 is urged by a spring 11 so as to be brought into contact with a terminal 13 of a spark plug 12 inserted into a lower portion of the insulator 4.

In this known ignition system, since electrical sealing property between the spark plug 12 and the insulator 4 is required to be upgraded in response to rise of required voltage, the bore of the insulator 4 is reduced in diameter so as to powerfully clamp an insulator portion 12*a* of the spark plug 12.

However, in the known ignition system, the ignition coil 8 and the electrical conductor 5 are adapted to be separated from each other functionally. Therefore, if the ignition coil 8 is lifted upwardly with a hand when the ignition system is removed from the engine 1, large clamping force applied to the spark plug 12 by the insulator 4 removes the ignition coil 8 from the insulator 4 before the insulator 4 is separated from the spark plug 12. As a result, the insulator 4, the electrical conductor 5, etc. remain in the hole 3 of the engine 1 undesirably.

In order to eliminate this drawback, it may be considered that the ignition coil 8 is clamped by the insulator 4 more powerfully. However, in this case, since force for inserting the ignition coil 8 into the insulator 4 is also increased, such an inconvenience is incurred that working efficiency for inserting the ignition coil 8 into the insulator 4 deteriorates. Alternatively, if the ignition coil 8 is bonded to the electrical conductor 5 and the insulator 4, such a problem arises that these element 4, 5 and 8 cannot be replaced with new ones separately.

SUMMARY OF THE INVENTION

Accordingly, an essential object of the present invention is to provide, with a view to eliminating the above mentioned drawbacks of prior art ignition systems, a joint construction for an ignition system, in which a rodlike high-voltage terminal provided at an ignition side such as an ignition coil or an ignition cable and a tubular electrical conductor are detachably coupled with each other and the electrical conductor and an insulator can be separated from a spark plug positively when the ignition coil is lifted separately from the spark plug.

Another important object of the present invention is to provide a joint construction for an ignition system, in which when the electrical conductor, an elastic ring and an insulating sleeve are preliminarily assembled with each other, the high-voltage terminal can be inserted into the electrical conductor easily and is securely coupled with the electrical conductor after insertion of the high-voltage terminal into the electrical conductor.

In order to accomplish these objects of the present invention, a joint construction between a rodlike high-voltage terminal provided at a distal end of an ignition coil or an ignition cable and a tubular electrical conductor in an ignition system, in which the high-voltage terminal is fitted into the electrical conductor so as to be connected to a spark plug through the electrical conductor, according to the present invention comprises: the high-voltage terminal being formed, on its outer periphery, with a recess; the electrical conductor being formed with a through-hole confronting the recess; a ring which has a boss and is fitted around the electrical conductor such that the boss is brought into engagement with the recess of the high-voltage terminal via the thorough-hole of the electrical conductor; an insulating sleeve which is fitted around the electrical conductor and the ring and has an inside diameter for regulating not only radial expansion of the ring but separation of the high-voltage terminal from the electrical conductor; and a locking member for detachably locking the insulating sleeve to the ignition coil or the ignition cable.

The locking member for locking the insulating sleeve to the ignition coil is formed by a locking portion provided on the insulating sleeve and a mating locking portion engageable with the locking portion and provided on the ignition coil but may alternatively be formed by an insulating cap having first and second locking portions engageable with first and second mating locking portions provided on the ignition coil and the insulating sleeve, respectively. Furthermore, in addition to the locking portion and the mating locking portion referred to above, the insulating cap may also be provided such that so-called double locking of the insulating sleeve to the ignition coil is achieved.

When the ignition coil is lifted, the insulating sleeve is also forcibly lifted together with the ignition coil by the locking member.

In the present invention, the high-voltage terminal is fitted into the electrical conductor and the boss of the ring fitted around the electrical conductor is projected inwardly from the through-hole of the electrical conductor so as to be brought into engagement with the recess of the high-voltage terminal by its shrinkage force such that the high-voltage terminal and the electrical conductor are connected to each other.

On the other hand, the insulating sleeve is fitted around the ring. Therefore, radial expansion of the boss of the ring is regulated by the insulating sleeve fitted around the ring and thus, the boss of the ring is prevented from being disengaged from the recess of the high-voltage terminal.

Accordingly, even if the ignition coil is lifted, the boss of the ring is locked by the insulating sleeve so as not to be disengaged from the recess of the high-voltage terminal. As a result, since the high-voltage terminal is prevented from being separated from the electrical conductor, the high-voltage terminal and the electrical conductor are connected to each other positively.

Meanwhile, the insulating sleeve is secured directly to the ignition coil by the locking portion and the mating locking portion or indirectly to the ignition coil through the insulating cap. Hence, when the high-voltage terminal coupled with the ignition coil is lifted, the insulating sleeve is also lifted positively together with the high-voltage terminal. Accordingly, the insulating sleeve is removed from the spark plug together with the ring and the electrical conductor while restricting radial expansion of the ring.

On the other hand, in order to insert the high-voltage terminal into the electrical conductor, the following steps are taken. Namely, after the high-voltage terminal has been inserted into the electrical conductor, the ring is fitted around the electrical conductor and then, the insulating sleeve is fitted around the ring. Therefore, since force for inserting the high-voltage terminal into the electrical conductor is not increased, the high-voltage terminal can be inserted into the electrical conductor easily.

BRIEF DESCRIPTION OF THE DRAWINGS

These objects and features of the present invention will become apparent from the following description taken in conjunction with the preferred embodiments thereof with reference to the accompanying drawings, in which.

Before the description of the present invention proceeds, it is to be noted that like parts are designated by like reference numerals throughout several views of the accompanying drawings.

DETAILED DESCRIPTION OF THE INVENTION

Figure 1:
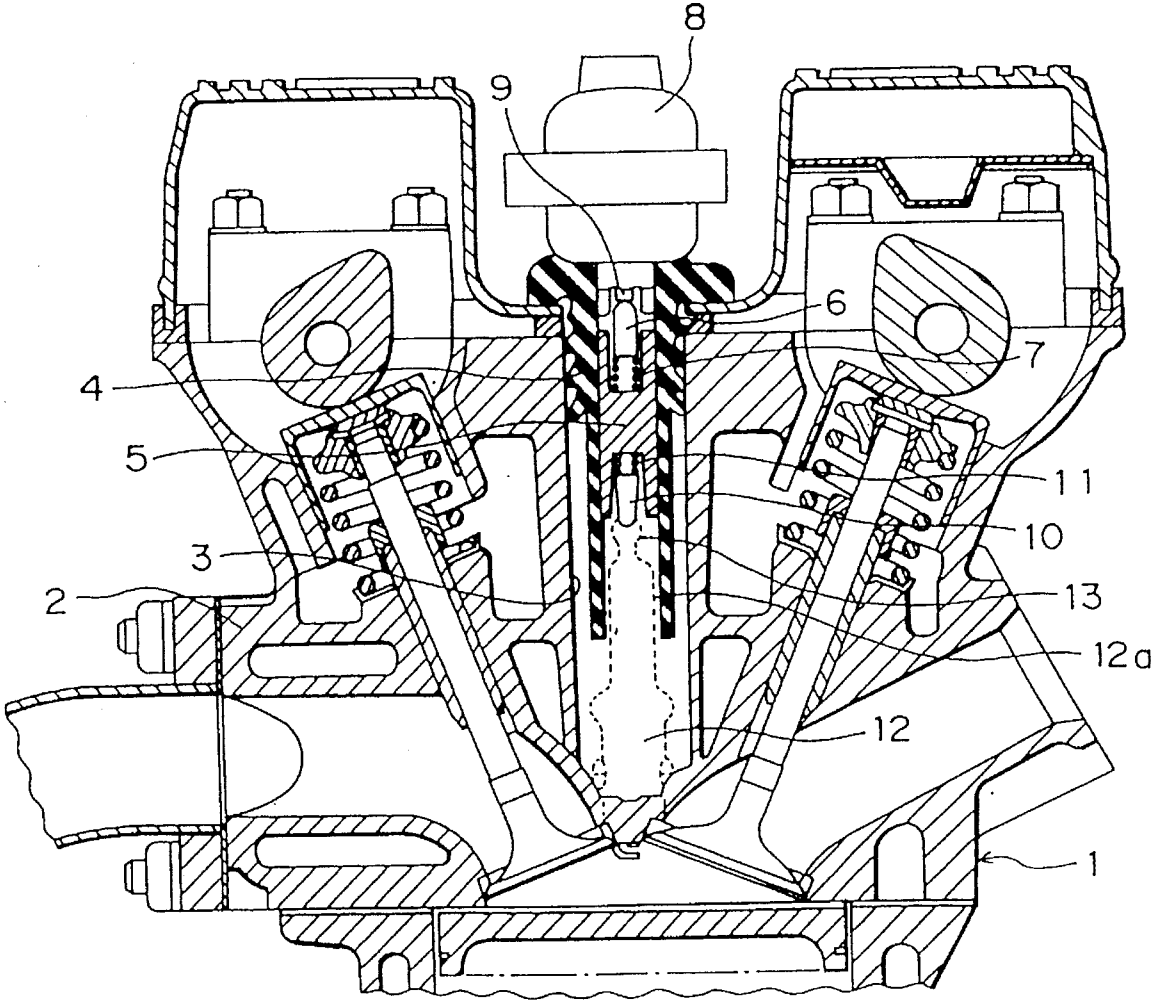
Fig. 1 PRIOR ART
FIG. 1 is a sectional view of a prior art joint construction for an ignition system (already referred to)
Figure 2:
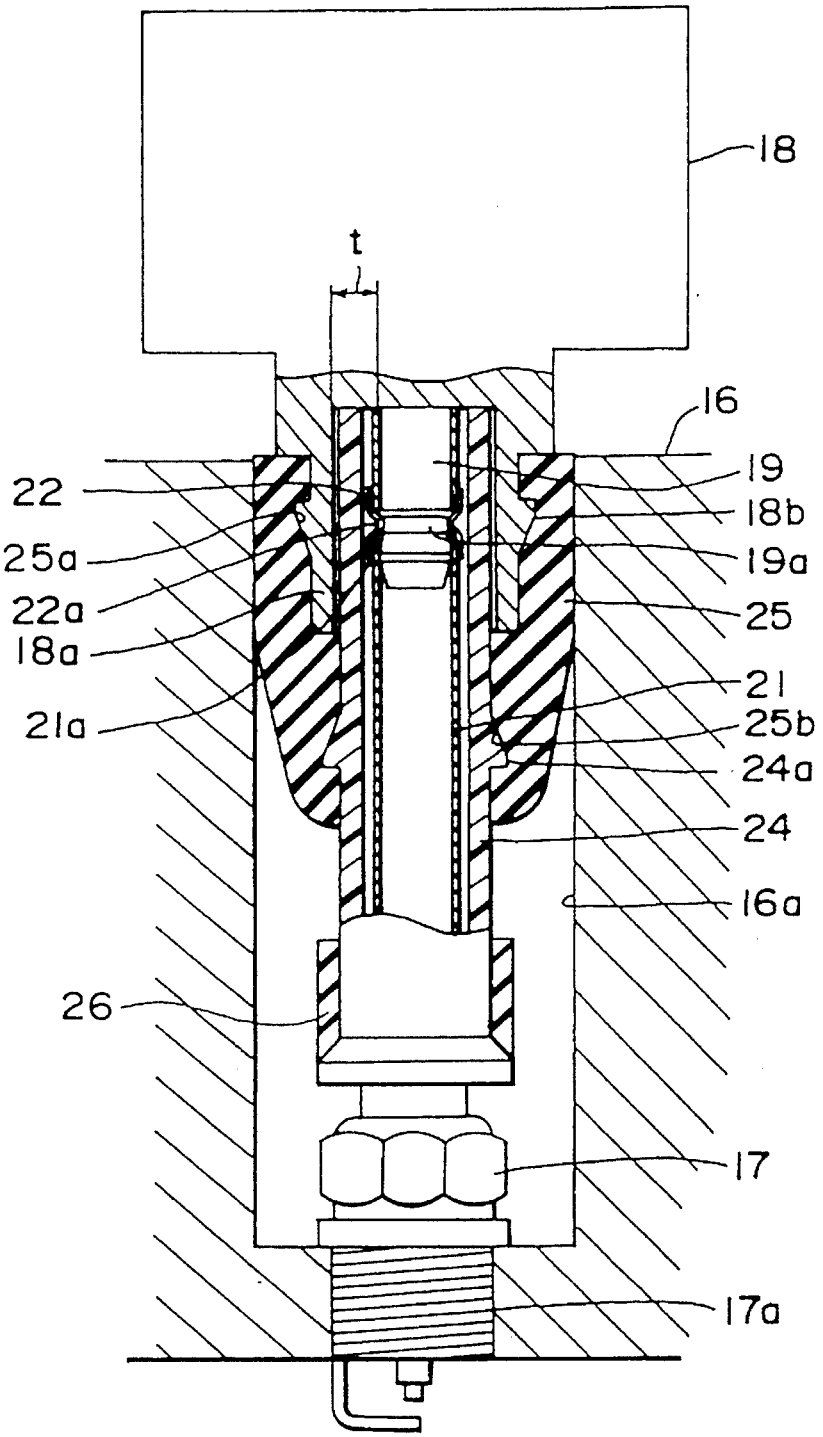
FIG. 2 is a sectional view of a joint construction for an ignition system, according to a first embodiment of the present invention.

Referring now to the drawings, there is shown in FIG. 2, a joint construction for an ignition system, according to a first embodiment of the present invention, in which an ignition coil and a spark plug are connected to each other by an electrical conductor in an internal combustion engine. In FIG. 2, a hole 16*a* is formed on a cylinder head 16 of an engine and a spark plug 17 is secured to a bottom portion of the hole 16*a* by a threaded portion 17*a* of the spark plug 17. Although not specifically shown, the spark plug 17 is provided with an insulator portion and a terminal.

On the other hand, a tubular insertion portion 18*a* is provided at a lower portion of an ignition coil 18 and has a downwardly opening hollow. An annular projection 18*b* is formed on an outer periphery of the insertion portion 18*a*. A rodlike high-voltage terminal 19 is provided in the hollow of the insertion portion 18*a* of the ignition coil 18 integrally with the insertion portion 18*a* so as to be spaced a predetermined distance t from a peripheral surface of the hollow of the insertion portion 18*a*. An annular recess 19*a* is formed on an outer periphery of the high-voltage terminal 19.

A long tubular electrical conductor 21 is provided and a lower portion of the electrical conductor 21 is electrically connected to the terminal of the spark plug 17 through a spring (not shown). An upper inner periphery of the electrical conductor 21 is fitted around the outer periphery of the high-voltage terminal 19 so as to be electrically connected to the high-voltage terminal 19. Two through-holes 21*a* are formed at an upper portion of the electrical conductor 21 so as to confront the recess 19*a* of the high-voltage terminal 19.

An elastic ring 22 having a boss 22*a* is engaged with the through-holes 21*a* of the electrical conductor 21 such that the boss 22*a* is engaged with the recess 19*a* of the high-voltage terminal 19 via the through-holes 21*a*. The elastic ring 22 is preliminarily fitted around an outer periphery of the electrical conductor 21 such that the boss 22*a* projects inwardly from the through-holes 21*a*. When the high-voltage terminal 19 is fitted into the inner periphery of the electrical conductor 21 from its uppermost mouth in the above described state, the boss 22*a* rides on the outer periphery of the high-voltage terminal 19 so as to be expanded in diameter. Then, when the boss 22*a* falls into the recess 19*a* of the high-voltage terminal 19, the boss 22*a* shrinks to its original diameter and thus, the high-voltage terminal 19 and the electrical conductor 21 are positively connected to each other by the elastic ring 22.

In order to enclose the tubular electrical conductor 21, a long insulating sleeve 24 made of synthetic resin is provided. A rubber bushing 26 is fitted around a lower portion of the insulating sleeve 24 and an insulator portion of the spark plug 17 so as to electrically seal the lower portion of the insulating sleeve 24 and the insulator portion of the spark plug 17. An inner periphery of the rubber bushing 26 is formed small in diameter so as to not only upgrade its electrical sealing property but clamp the insulator portion of the spark plug 17 powerfully.

An outer periphery of an upper portion of the insulating sleeve 24 is fitted into an inner periphery of the insertion portion 18*a* of the ignition coil 18. An annular boss 24*a* is formed on the outer periphery of the upper portion of the insulating sleeve 24 at its location distant from the insertion portion 18*a*.

The inner periphery of the insulating sleeve 24 encloses outer peripheries of the electrical conductor 21 and the elastic ring 22 and is set to such a diameter as to be spaced a slight distance from an the outer periphery of the elastic ring 22 such that radial expansion of the boss 22*a* of the elastic ring 22 is restricted by the insulating sleeve 24.

Furthermore, an insulating cap 25 made of rubber is provided. An inner periphery of an upper portion of the insulating cap 25 is fitted around the outer periphery of the insertion portion 18*a* of the ignition coil 18, while an inner periphery of a lower portion of the insulating cap 25 is fitted around the outer periphery of the insulating sleeve 24. An annular recess 25*a* engageable with the annular projection 18*b* of the insertion portion 18*a* is formed on the inner periphery of the upper portion of the insulating cap 25, while an annular recess 25*b* engageable with the annular boss 24*a* of the insulating sleeve 24 is formed on the inner periphery of the lower portion of the insulating cap 25.

The annular projection 18*b* projecting from the outer periphery of the insertion portion 18*a* is increased in diameter upwardly so as to an engagement face on its upper end face. When the annular projection 18*b* is brought into engagement with the annular recess 25*a* of the insulating cap 25 so as to lock the ignition coil 18 to the insulating cap 25, the insulating cap 25 is forcibly lifted together with the ignition coil 18 in response to ascent of the insertion portion 18*a*.

Meanwhile, the annular boss 24*a* of the insulating sleeve 24 is increased in diameter downwardly so as to have an engagement face on its lower end face. When the annular boss 24*a* is brought into engagement with the annular recess 25*b* of the insulating cap 25 so as to lock the insulating sleeve 24 to the insulating cap 25, the insulating sleeve 24 is forcibly lifted together with the insulating cap 25 in response to ascent of the insulating cap 25.

Figures 3A, 3B, 3C, 3D:
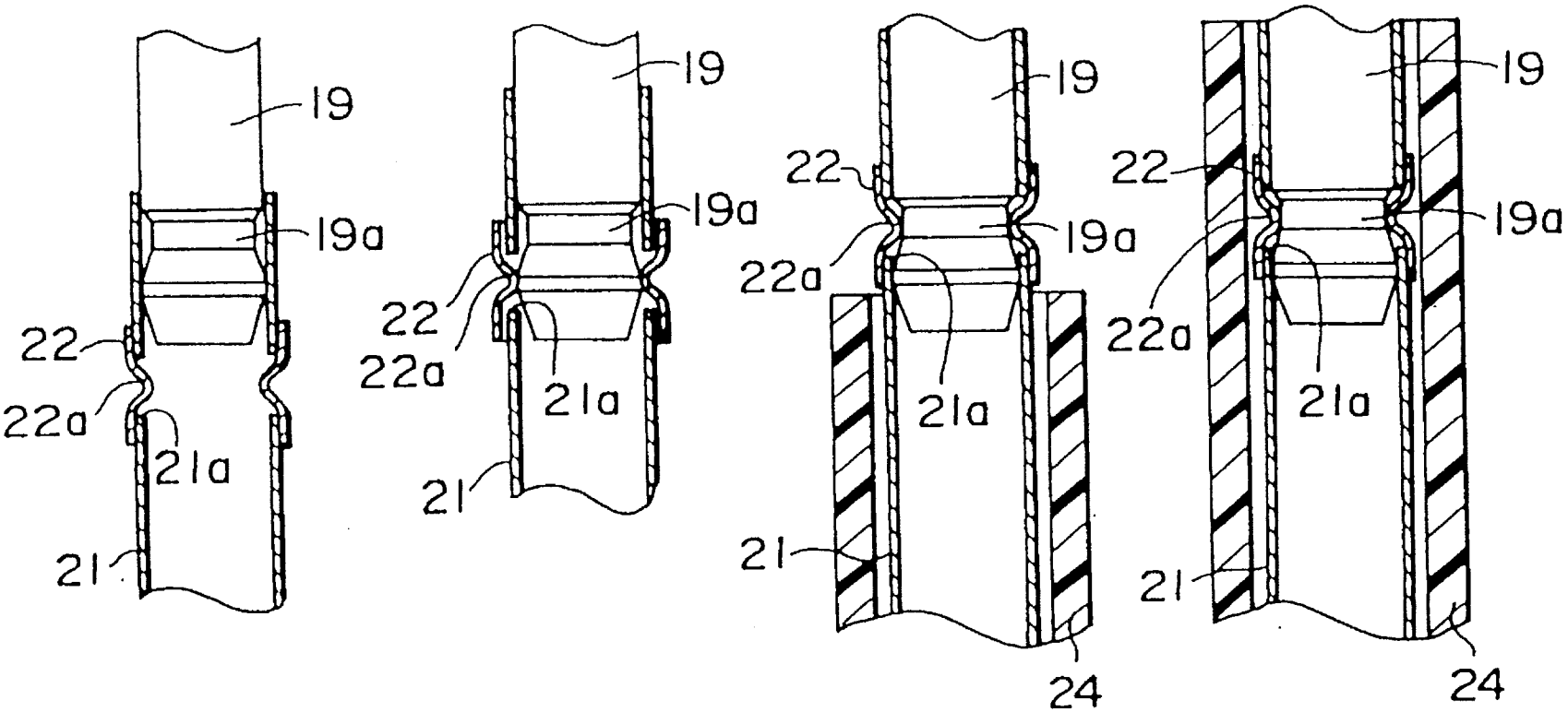
FIGS. 3A to 3D are views explanatory of assembly steps of the joint construction of FIG. 2.

For assembling the ignition system of the above described arrangement, the inner periphery of the upper portion of the electrical conductor 21 is initially fitted around the high-voltage terminal 19 as shown in FIG. 3A. The elastic ring 22 is preliminarily engaged with the outer periphery of the electrical conductor 21 such that the boss 22*a* of the elastic ring 22 projects inwardly from the through-holes 21*a*. During fitting of the electrical conductor 21 around the high-voltage terminal 19, the boss 22*a* rides on the outer periphery of high-voltage terminal 19 and then, falls into the annular recess 19*a* of the high-voltage terminal 19 as shown in FIG. 3B so as to be reduced in diameter such that the electrical conductor 21 and the high-voltage terminal 19 are positively coupled with each other through the elastic ring 22.

Subsequently or before the high-voltage terminal 19 is inserted into the electrical conductor 21, the outer periphery of the upper portion of the insulating cap 25 is fitted around the outer periphery of the insertion portion 18*a* of the ignition coil 18 so as to bring the annular recess 25*a* of the insulating cap 25 into engagement with the annular projection 18*b* of the insertion portion 18*a* such that the insulating cap 25 is coupled with the insertion portion 18*a*.

Thereafter, the inner periphery of the insulating sleeve 24 is fitted around the electrical conductor 21 as shown in FIG. 3C and then, the outer periphery of the elastic ring 22 as shown in FIG. 3D. Then, as shown in FIG. 2, the inner periphery of the insulating sleeve 24 is fitted into the inner periphery of the insertion portion 18*a* of the ignition coil 18 such that an insertion end face of the insulating sleeve 24 bumps against a bottom of the inner periphery of the insertion portion 18*a*. When the inner periphery of the insulating sleeve 24 is fitted around the outer periphery of the elastic ring 22, radial expansion of the boss 22*a* of the elastic ring 22 is restricted by the inner periphery of the insulating sleeve 24 and thus, the boss 22*a* is prevented from being brought out of engagement with the annular recess 19*a* of the high-voltage terminal 19.

Meanwhile, since the insulating sleeve 24 is also fitted into the inner periphery of the insulating cap 25, the annular boss 24*a* is brought into engagement with the annular recess 25*b* and thus, the insulating sleeve 24 is coupled with the insulating cap 25.

In a state where the electrical conductor 21, the elastic ring 22, the insulating sleeve 24 and the insulating cap 25 have been mounted on the ignition coil 18 as described above, the insulating sleeve 24 is inserted into the hole 16*a* of the cylinder head 16 as shown in FIG. 2 such that the rubber bushing 26 is fitted around the lower portion of the insulating sleeve 24 and the insulator portion of the spark plug 17.

If the ignition coil 18 is lifted upwardly with a hand when the assembled ignition coil is removed, the boss 22*a* of the elastic ring 22 is locked by the inner periphery of the insulating sleeve 24 so as not to be brought out of engagement with the annular recess 19*a* of the high-voltage terminal 19 through radial expansion of the boss 22*a*. Hence, the electrical conductor 21 is not separated from the high-voltage terminal 19. Furthermore, the insulating sleeve 24 regulating radial expansion of the elastic ring 22 is not separated from the insulating cap 25 through engagement between the annular boss 24*a* and the annular recess 25*b* and the insulating cap 25 is not separated from the ignition coil 18 through engagement between the annular projection 18*b* and the annular recess 25*a*. Thus, when the ignition coil 18 is lifted, the insulating cap 25, the insulating sleeve 24, the electrical conductor 21 and the elastic ring 22 are forcibly lifted together with the ignition coil 18.

Even if the rubber bushing 26 having small inside diameter is fitted around the lower portion of the insulating sleeve 24 so as to powerfully clamp the insulator portion of the spark plug 17 such that electrical sealing property between the spark plug 17 and the insulating sleeve 24 is improved, such a phenomenon does not take place due to above described locking of the insulating sleeve 24 to the insulating cap 25 that the electrical conductor 21, the insulating sleeve 24, etc. remain in the hole 16*a* of the cylinder head 16 through separation of the electrical conductor 21 from the high-voltage terminal 19. Thus, by raising electrical sealing property between the spark plug 17 and the insulating sleeve 24, reliability of the ignition system can be improved.

Moreover, only when the insulating sleeve 24 encloses the outer periphery of the elastic ring 22, the insulating sleeve 24 is locked to the insulating cap 25. Since the insulating sleeve 24 does not enclose the outer periphery of the elastic ring 22 when the high-voltage terminal 19 and the electrical conductor 21 are coupled with each other by the elastic ring 22, force required for inserting the high-voltage terminal 19 into the electrical conductor 21 is not increased, so that the high-voltage terminal 19 can be inserted into the electrical conductor 21 easily.

Meanwhile, when the ignition coil 18 or the electrical conductor 21 is replaced with a new one, engagement between the annular recess 25*b* of the insulating cap 25 and the annular boss 24*a* of the insulating sleeve 24 is cancelled initially so as to draw the insulating sleeve 24 from the insulating cap 25. Then, by pulling the electrical conductor 21, the boss 22*a* of the elastic ring 22 is increased in diameter and thus, is disengaged from the annular recess 19*a* of the high-voltage terminal 19. As a result, the electrical conductor 21 can be removed from the high-voltage terminal 19.

Figure 4:
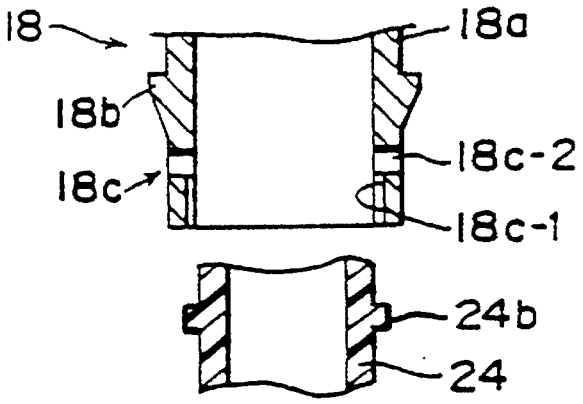
FIG. 4 is a fragmentary sectional view of a key type lock employed in a modification of the joint construction of FIG. 2.
Figure 5:
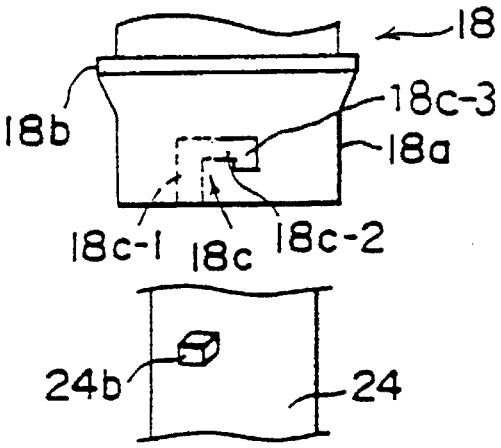
FIG. 5 is a side elevational view of the key type lock of FIG. 4.

The present invention is not restricted to the above described embodiment and may be modified to a key type lock shown in FIGS. 4 and 5 in which the insulating sleeve 24 is directly locked to the insertion portion 18*a* of the ignition coil 18. Namely, a pair of slots 18*c* are formed on the insertion portion 18*a* and each includes a vertical slot 18*c*-1 extending upwardly on the inner periphery of the insertion portion 18 from its lower end, a horizontal slot 18*c*-2 extending horizontally from an upper end of the vertical slot 18*c*-1 and an engagement slot 18*c*-3 bent downwardly from a distal end of the horizontal slot 18*c*-2. The vertical slot 18*c*-1 does not pierce a side wall of the insertion portion, while the horizontal slot 18*c*-2 and the engagement slot 18*c*-3 pierce the side wall of the insertion portion 18*a*. A pair of projections 24*b* engageable with the slots 18*c* are formed on the outer periphery of the insulating sleeve 24.

The projection 24*b* is inserted into the slot 18*c* from a lower end mouth of the vertical slot 18*c*-1. Then, when the projection 24*b* has reached the upper end of the vertical slot 18*c*-1, the projection 24*b* is rotated horizontally so as to be inserted into the horizontal slot 18*c*-2 and is displaced along the horizontal slot 18*c*-2. Subsequently, the projection 24*b* is fitted into the engagement slot 18*c*-3 so as to be brought into engagement with the engagement slot 18*c*-3. Therefore, when the ignition coil 18 is pulled upwardly, the insulating sleeve 24 having the projections 24*b* held in engagement with the slots 18*c* of the ignition coil 18 are not separated from the ignition coil 18 and thus, is pulled together with the ignition coil 18.

Meanwhile, the arrangement of FIGS. 4 and 5 may also be added to the embodiment of FIG. 2. Namely, in the embodiment of FIG. 2, in case forces of engagement between the annular boss 24*a* of the insulating sleeve 24 and the annular recess 25*b* of the insulating cap 25 and engagement between the annular projection 18*b* of the insertion portion 18*a* of the ignition coil 18 and the annular recess 25*a* of the insulating cap 25 are small and thus, the insulating sleeve 24, etc. may remain in the hole 16*a*, the arrangement shown in FIGS. 4 and 5 is preferably added to the embodiment of FIG. 2. As a result, double locking is obtained in which in addition to locking of the insulating sleeve 24 to the insertion portion 18*a* through the insulating cap 25, the insulating sleeve 24 is also directly locked to the insertion portion 18*a*.

Meanwhile, locking through engagement of the projections 24*b* with the slots 18*c* may also be replaced by threaded locking which the insulating sleeve 24 is screwed into the insertion portion 18*a*.

Furthermore, the above described embodiment is applied to the ignition system in which the ignition coil is connected to the spark plug. However, needless to say, the present invention can also be applied to an ignition system in which a high-voltage terminal is connected to a terminal of an ignition cable.

As is clear from the foregoing description of the first embodiment of the present invention, the rodlike high-voltage terminal provided at the distal end of the ignition coil or the ignition cable of the internal combustion engine is connected to the spark plug through the tubular electrical conductor and the tubular electrical conductor is coupled with the rodlike high-voltage terminal by using the elastic ring. Furthermore, coupling between the tubular electrical conductor and the rodlike high-voltage terminal by the elastic ring is secured by the insulating sleeve and the insulating sleeve is locked to an housing having the high-voltage terminal fixed thereto, i.e., the ignition coil.

Accordingly, when the high-voltage terminal is pulled upwardly separately from the spark plug, the electrical conductor is coupled with the high-voltage terminal by the elastic ring and thus, the high-voltage terminal can be pulled upwardly together with the electrical conductor. In addition to the electrical conductor and the elastic ring, the high-voltage terminal can be pulled upwardly positively together with also the insulating sleeve. Accordingly, it is possible to eliminate such a phenomenon in which the electrical conductor, the insulating sleeve, etc. remain in the hole of the cylinder head of the internal combustion engine.

Even if the high-voltage terminal is lifted upwardly, radial expansion of the boss of the elastic ring is restricted by the inner periphery of the insulating sleeve such that the boss of the elastic ring is not disengaged from the recess of the high-voltage terminal. Therefore, even when the spark plug has been clamped powerfully by the insulating sleeve through the rubber bushing, the high-voltage terminal is not separated from the electrical conductor, so that electrical sealing property between the spark plug and the insulating sleeve is upgraded, thereby resulting in improvement of reliability of the ignition system.

Meanwhile, the insulating sleeve locks the boss of the elastic ring to the recess of the high-voltage terminal only when the insulating sleeve encloses the outer periphery of the elastic ring, while the insulating sleeve does not enclose the outer periphery of the elastic ring when the high-voltage terminal and the electrical conductor are coupled with each other by the elastic ring. Accordingly, since force required for inserting the high-voltage terminal into the electrical conductor is not increased, the high-voltage terminal can be inserted into the electrical conductor efficiently.

Meanwhile, in the first embodiment of the present invention, the high-voltage terminal 19 of the ignition coil 18 can be assembled with the electrical conductor 21, the elastic ring 22 and the insulating sleeve 24 without any problem in the following operational steps. Namely, the high-voltage terminal 19 is initially inserted into the electrical conductor 21 and then, the elastic ring 22 is fitted around the electrical conductor 21. Subsequently, the boss 22*a* of the elastic ring 22 is brought into engagement with the annular recess 19*a* of the high-voltage terminal 19 via the through-holes 21*a* of the electrical conductor 21. Thereafter, the insulating sleeve 24 is fitted around the electrical conductor 21.

However, since a maker of the ignition coil 18 is usually different from those of the joint components including the electrical conductor 21, the electrical conductor 21, the elastic ring 22 mounted on the electrical conductor 21 and the insulating sleeve 24 fitted around the electrical conductor 21 are preliminarily assembled with each other. In this state, the high-voltage terminal 19 of the ignition coil 18 is connected to the electrical conductor 21.

Figure 6A:
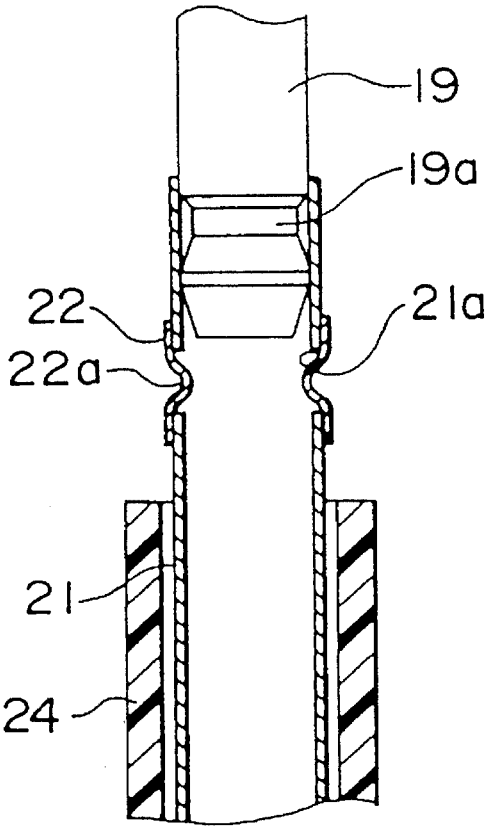
FIGS. 6A and 6B are sectional views showing assembly of the joint construction of FIG. 2.

Namely, as shown in FIG. 3A, the elastic ring 22 is preliminarily mounted on the electrical conductor 21 such that the boss 22*a* of the elastic ring 22 projects into the electrical conductor 21 via the through-holes 21*a* of the electrical conductor 21. Therefore, in case the elastic ring 22 is disposed at a location of the electrical conductor 21 distant outwardly from an open end of the insulating sleeve 24 as shown in FIG. 6A when the high-voltage terminal 19 is inserted into the electrical conductor 21, an insertion end of the high-voltage terminal 19 is brought into contact with the boss 22*a* of the elastic ring 22. Thus, large force is required for inserting the high-voltage terminal 19 into the electrical conductor 21. In addition, if the high-voltage terminal 19 is forcibly inserted into the electrical conductor 21, the boss 22*a* and the distal end of the high-voltage terminal 19 may be damaged.

Figure 6B:
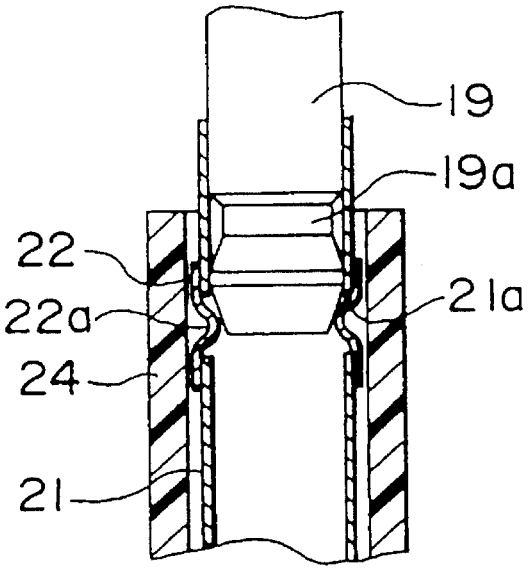

On the other hand, in case the elastic ring 22 is disposed in the insulating sleeve 24 as shown in FIG. 6B when the high-voltage terminal 19 is inserted into the electrical conductor 21, inside diameter is set at such a dimension as to restrain radial expansion of the elastic ring 22, so that radial expansion of the elastic ring 22 is prevented by the insulating sleeve 24 and thus, it is impossible to insert the high-voltage terminal 19 into the electrical conductor 21.

Figure 7:
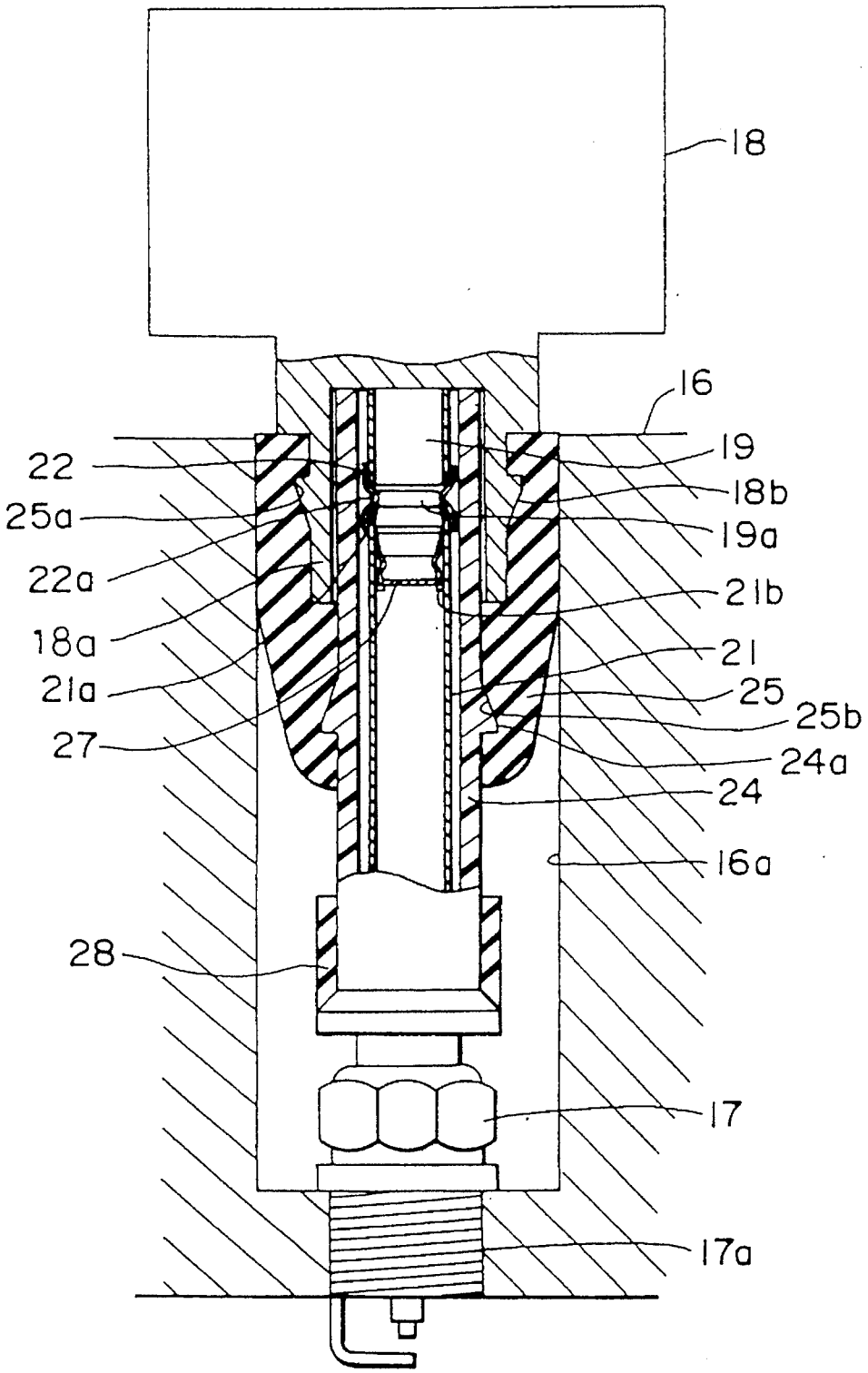
FIG. 7 is a sectional view of a joint construction for an ignition system, according to a second embodiment of the present invention.

FIG. 7 shows a joint construction for an ignition system, according to a second embodiment of the present invention. By connecting the high-voltage terminal 19 to the terminal of the spark plug 17 through the electrical conductor 21, the ignition coil 18 and the spark plug 17 are electrically connected to each other. A radially inwardly extending stopper 21*b* is formed at a location below each of the through-holes 21*a* on an inner periphery of the electrical conductor 21. When the high-voltage terminal 19 is inserted into the electrical conductor 21 so as to be coupled with the electrical conductor 21, the stopper 21*b* is adapted to be brought into engagement with a lower end face of a retainer 27 which is slidably fitted into the electrical conductor 21.

Figure 9:
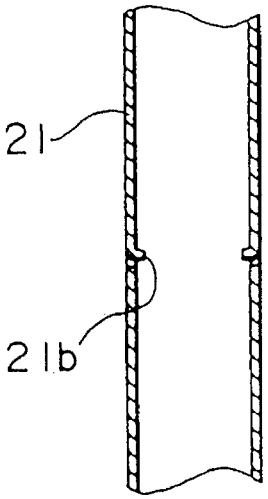
FIG. 9 is a sectional view of an engageable piece employed in the joint construction of FIG. 7.
Figure 10:
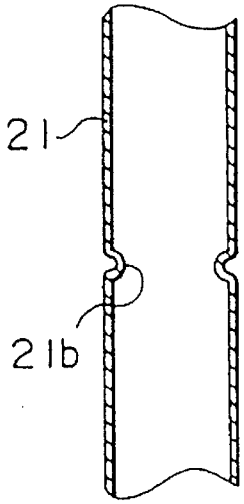
FIGS. 10 and 11 are sectional views showing first and second modifications of the engageable piece of FIG. 9, respectively.
Figure 11:
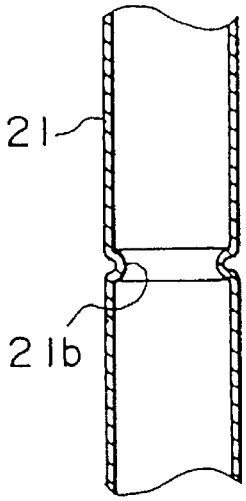

As shown in FIG. 9, the stopper 21*b* is formed by slitting and raising a peripheral wall of the electrical conductor 21. The stopper 21*b* may also be formed by bending a portion of the peripheral wall of the electrical conductor 21 inwardly as shown in FIG. 10 or by bending a whole circumference of the peripheral wall of the electrical conductor 21 as shown in FIG. 11.

Figures 8A, 8B, 8C, 8D, 8E:
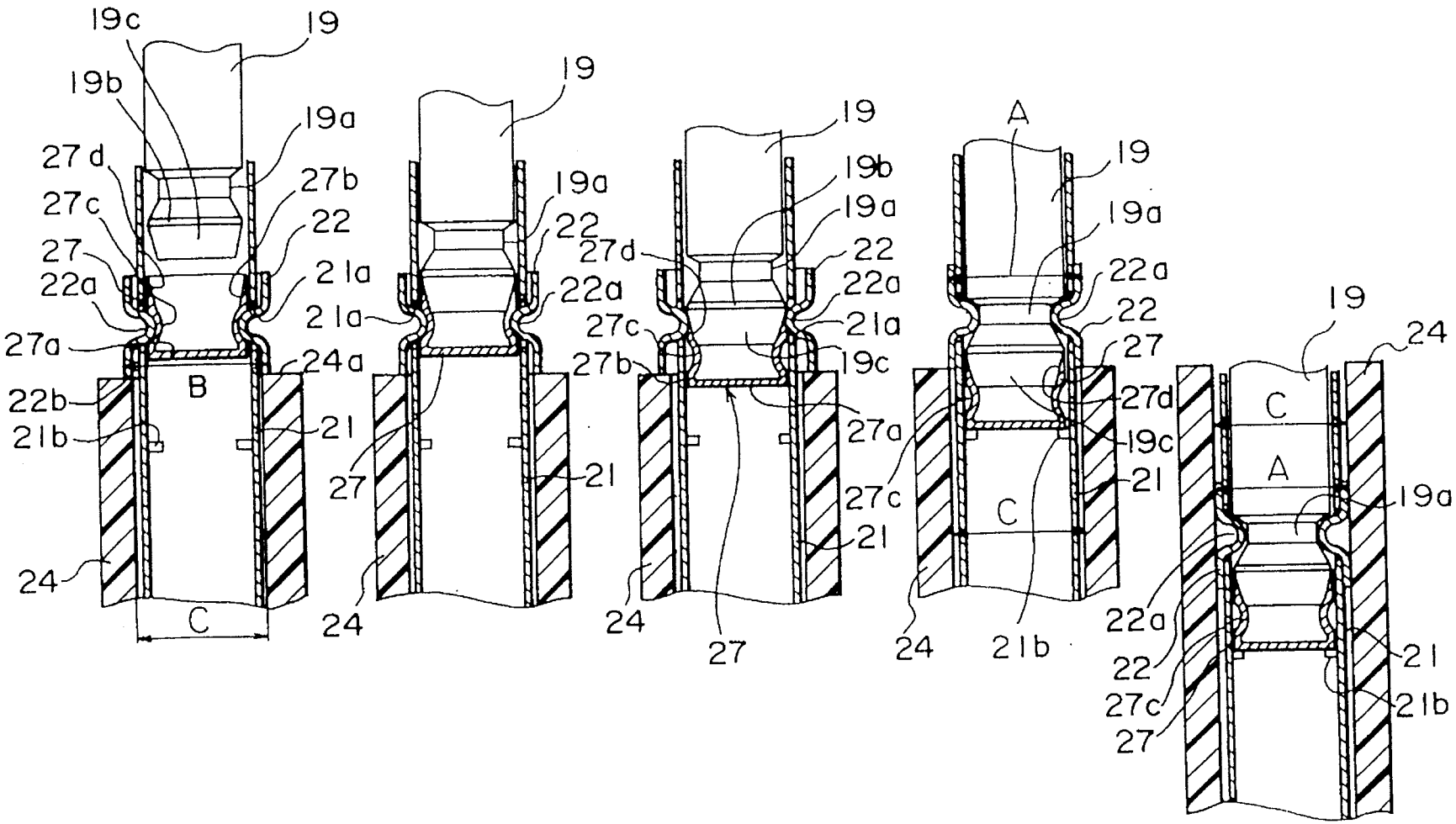
FIGS. 8A to 8E are views explanatory of assembly steps of the joint construction of FIG. 7.

In a state where the high-voltage terminal 19 has been coupled with the electrical conductor 21 through the elastic ring 22, the boss 22*a* of the elastic ring 22 is brought into engagement with the annular recess 19*a* of the high-voltage terminal 19 when the elastic ring 22 is closely fitted around the outer periphery of the electrical conductor 21 as shown in FIG. 8E. At this time, the elastic ring 22 is set at a diameter A.

Furthermore, in a state where the boss 22*a* of the elastic piece 22 has been brought into engagement with the annular recess 19*a* of the high-voltage terminal 19, the elastic piece 22 is closely fitted into the insulating sleeve 24 such that radial expansion of the elastic ring 22 is restrained by the insulating sleeve 24. As a result, the boss 22*a* is not disengaged from the annular recess 19*a*. Thus, an inside diameter C of the insulating sleeve 24 is set at a dimension equal to or slightly larger than the diameter A of the elastic ring 22.

As shown in FIGS. 8A to 8E, the retainer 27 is of a tubular shape having an open upper end and a closed lower face 27*a*. A concave 27*c* is curved radially inwardly at a central portion of a peripheral wall 27*b* of the retainer 27. An outer peripheral surface of the peripheral wall 27*b* at upper and lower portions of the concave 27*c* is set at such a dimension as to be brought into sliding contact with an inner peripheral surface of the electrical conductor 21. An oblique wall 27*d* extends radially outwardly from the upper portion of the concave 27*c* and is so set as to extend along an outer peripheral surface of a conical portion 19*c* of the high-voltage terminal 19. The conical portion 19*c* is disposed at a distal end of the high-voltage terminal 19 so as to abut on a maximum diameter portion 19*b*. In addition, the oblique wall 27*d* is formed gradually smaller in thickness towards its upper portion so as to have a V-shaped upper end.

The retainer 27 is so set as to expand diameter of the elastic ring 22 to a dimension B larger than the inside diameter C of the insulating sleeve 24 when the concave 27*c* has been brought into engagement with the boss 22*a* of the elastic ring 22. Therefore, the dimensions A, B and C can be expressed by the following relation.

$$A \leqq C < B$$

Since the outside diameter of the elastic ring 22 is so set as to be larger than the inside diameter of the insulating sleeve 24, an end face 22*b* of the elastic ring 22 is brought into contact with an end face 24*a* of the insulating sleeve 24. The insulating sleeve 24 is made of synthetic resin and is long enough to not only enclose the electrical conductor 21 but enclose a joint portion between the electrical conductor 21 and the spark plug 17 through a rubber bushing 28.

Hereinbelow, steps of assembly of the high-voltage terminal 19 with the electrical conductor 21 are described with reference to FIGS. 8A to 8E. Prior to insertion of the high-voltage terminal 19 into the electrical conductor 21 as shown in FIG. 8A, an upper portion of the electrical conductor 21 and the elastic ring 22 engaged with the electrical conductor 21 are exposed upwardly from the end face 24*a* of the insulating sleeve 24, while the concave 27*c* of the retainer 27 is brought into engagement with the boss 22*a* of the elastic ring 22. In this state, since the retainer 27 is held in engagement with the boss 22*a*, diameter of the elastic ring 22 is expanded to the dimension B larger than the inside diameter C of the insulating sleeve 24, the end face 22*b* of the elastic ring 22 is brought into contact with the end face 24*a* of the insulating sleeve 24. Thus, prior to insertion of the high-voltage terminal 19 into the electrical conductor 21, the elastic ring 22 is not inserted into the insulating sleeve 24 and thus, the elastic ring 22 can be projected out of the insulating sleeve 24 positively.

When the electrical conductor 21, the elastic ring 22 and the insulating sleeve 24 have been assembled as described above, the high-voltage terminal 19 of the ignition coil 18 is inserted into the electrical conductor 21 from above. From the upper end mouth of the retainer 27 fitted into the electrical conductor 21, the high-voltage terminal 19 is initially inserted into the retainer 27 as shown in FIG. 8B.

When the high-voltage terminal 19 is further inserted into the electrical conductor 21, the retainer 27 is depressed downwardly by the high-voltage terminal 19, so that the boss 22*a* projecting into the electrical conductor 21 is depressed by the oblique wall 27*d* of the retainer 27 so as to be expanded in diameter as shown in FIG. 8C. At the time when an upper end of the oblique wall 27*d*, which projects most outwardly, has been brought into contact with the boss 22*a*, the elastic ring 22 is most expanded in diameter. Namely, in this state, the boss 22*a* is retracted to such a location as not to protrude into the electrical conductor 21 from its inner peripheral surface. In addition, since the oblique wall 27*d* of the retainer 27 has the V-shaped thin upper end, inside diameter of the upper end of the oblique wall 27*d* is substantially equal to that of the electrical conductor 21. As a result, the maximum diameter portion 19*b* of the high-voltage terminal 19 can be easily depressed downwardly beyond the location of the boss 22*a*.

When the maximum diameter portion 19*b* of the high-voltage terminal 19 has been displaced beyond the boss 22*a*, the recess 19*a* reaches the location of the boss 22*a* and thus, the boss 22*a* falls into the recess 19*a* so as to be brought into engagement with the recess 19*a* as shown in FIG. 8D. At this time, the oblique wall 27*d* of the retainer 27 is lowered along the conical portion 19*c* of the high-voltage terminal 19 but is stopped by the stopper 21*b* projecting radially inwardly from the inner peripheral surface of the electrical conductor 21.

In this state, the retainer 27 is disengaged from the boss 22*a* so as to cancel radial expansion of the elastic ring 22. Therefore, the boss 22*a* is brought into engagement with the recess 19*a* of the high-voltage terminal 19 and thus, the elastic ring 22 has the diameter A referred to above. Since the diameter A of the elastic ring 22 and the inside diameter C of the insulating sleeve 24 have the relation of ($A \leqq C$) as described above, the elastic ring 22 can be fitted into the insulating sleeve 24. Thus, as shown in FIG. 8E, the insulating sleeve 24 is raised so as to enclose the electrical conductor 21 and the elastic ring 22. At this time, since radial expansion of the elastic ring 22 is restrained by the insulating sleeve 24, the high-voltage terminal 19 and the electrical conductor 21 can be positively connected to each other through the elastic ring 22. Accordingly, when the ignition coil 18 is removed from the ignition system, such a phenomenon can be prevented in which the electrical conductor 21, the elastic ring 22 and the insulating sleeve 24 remain in the internal combustion engine through separation of the electrical conductor 21 from the high-voltage terminal 19.

Figure 12:
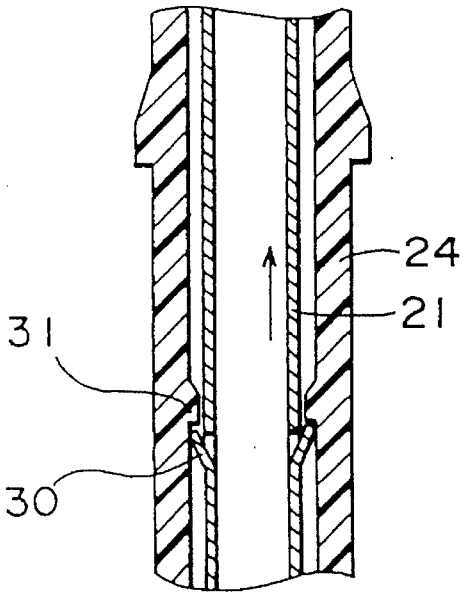
FIG. 12 is a sectional view showing engagement between an electrical conductor and an insulating sleeve prior to insertion of a high-voltage terminal into the electrical conductor in the ignition system of FIG. 7.
Figure 13:
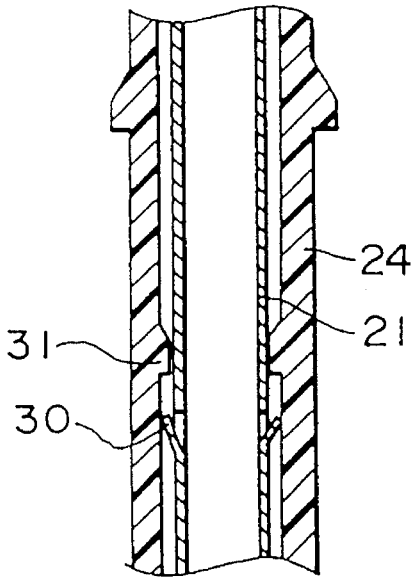
FIG. 13 is a sectional view showing engagement between the electrical conductor and the insulating sleeve after insertion of the high-voltage terminal into the electrical conductor in the ignition system of FIG. 7.
Figure 14:
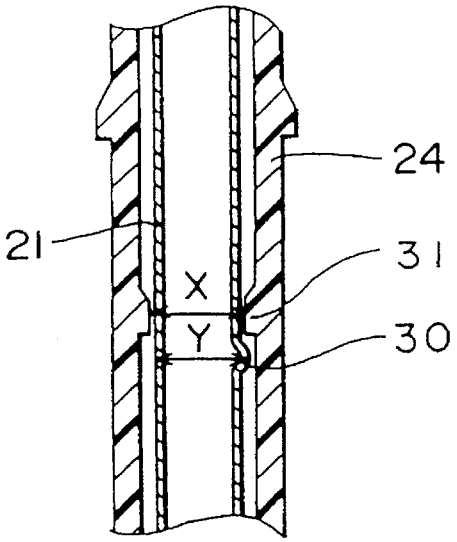
FIG. 14 is a sectional view showing a modification of engagement between the electrical conductor and the insulating sleeve in the ignition system of FIG. 7.

Furthermore, the present invention is not restricted to the above described second embodiment. In order to project only a necessary portion of the electrical conductor 21 adjacent to the high-voltage terminal 19 from the insulating sleeve 24 when the elastic ring 22, the electrical conductor 21, the insulating sleeve 24 and the rubber bushing 28 have been preliminarily assembled with each other, pieces 30 and 31 engageable with each other are, respectively, formed on the outer peripheral surface of the electrical conductor 21 and the inner peripheral surface of the insulating sleeve 24 as shown in FIGS. 12 to 14. Namely, as shown in FIG. 12, the piece 30 is projected outwardly from the outer peripheral surface of the electrical conductor 21 by slitting and raising the outer peripheral surface of the electrical conductor 21, while the piece 31 is projected inwardly from the inner peripheral surface of the insulating sleeve 24. When the piece 30 is brought into engagement with the piece 31 from below, upward displacement of the electrical conductor 21 in the direction of the arrow of FIG. 12 is prevented and a distance of projection of the electrical conductor 21 from the insulating sleeve 24 is regulated to a predetermined value. Meanwhile, when the electrical conductor 21 and the insulating sleeve 24 have been preliminarily assembled with each other, the electrical conductor 21 is not displaced in the direction opposite to that of the arrow of FIG. 12 and thus, it is necessary to regulate displacement of the electrical conductor 21 only in the direction of the arrow of FIG. 12. When the high-voltage terminal 19 is inserted into the electrical conductor 21 so as to be connected to the electrical conductor 21, the piece 30 is lowered so as to be disengaged from the piece 31 as shown in FIG. 13.

FIG. 14 shows a modification of the pieces 30 and 31. In FIG. 14, the piece 30 is formed by bending the peripheral wall of the electrical conductor 21 outwardly, while the piece 31 is the same as that of FIGS. 12 and 13. An outside diameter Y of the electrical conductor 21 at the piece 30 is so set as to be quite approximate to but larger than an inside diameter X of the insulating sleeve 24 at the piece 31.

As will be seen from the foregoing description of the ignition system according to the second embodiment of the present invention, since the retainer is fitted into the electrical conductor in a state where the elastic ring, the insulating sleeve and the rubber bushing have been preliminarily assembled with the electrical conductor for connecting the spark plug and the high-voltage terminal, the elastic ring can be held so as to project out of the insulating sleeve and the boss of the elastic ring can be so regulated as not to interfere with the high-voltage terminal at the time of insertion of the high-voltage terminal into the electrical conductor. Therefore, the high-voltage terminal can be easily inserted into the electrical conductor.

On the other hand, after the high-voltage terminal has been inserted into the electrical conductor, the boss of the elastic ring is brought into engagement with the recess of the high-voltage terminal and radial expansion of the elastic ring is regulated by the insulating sleeve. Therefore, the high-voltage terminal and the electrical conductor can be connected to each other positively and securely.

Furthermore, since the engageable pieces are provided in the electrical conductor, the retainer can be held at a predetermined position after the high-voltage terminal has been connected to the electrical conductor.

Moreover, since the pieces engageable with each other are, respectively, provided on the electrical conductor and the insulating sleeve, the electrical conductor can be mounted on the insulating sleeve so as not to be removed from the insulating sleeve.

What is claimed is:

1. A joint construction between a rodlike high-voltage terminal provided at a distal end of one of an ignition coil and an ignition cable and a tubular electrical conductor in an ignition system, in which the high-voltage terminal is fitted into the electrical conductor so as to be connected to a spark plug through the electrical conductor, the joint construction comprising:

the high-voltage terminal being formed, on its outer periphery, with a recess;

the electrical conductor being formed with a through-hole confronting the recess;

a ring having a boss and being fitted around the electrical conductor such that the boss is brought into engagement with the recess of the high-voltage terminal via the through-hole of the electrical conductor;

an insulating sleeve being fitted around the electrical conductor and the ring and having an inside diameter for regulating not only radial expansion of the ring but separation of the high-voltage terminal from the electrical conductor; and a locking member for detachably locking the insulating sleeve to one of the ignition coil and the ignition cable.

2. A joint construction as claimed in claim 1, wherein the locking member includes an insulating cap having first and second locking portions, one of the ignition coil and the ignition cable having a first mating locking portion and the insulating sleeve having a second mating locking portion, wherein the insulating cap is mounted on one of the ignition coil and the ignition cable and the insulating sleeve such that the first and second locking portions are brought into engagement with the first and second mating locking portions, respectively.

3. A joint construction as claimed in claim 1, wherein the locking member includes a locking portion provided on the insulating sleeve and a mating locking portion engageable with the locking portion and provided on one of the ignition coil and the ignition cable.

4. A joint construction as claimed in claim 2, wherein the locking member further includes a locking portion provided on the insulating sleeve and a mating locking portion engageable with the locking portion and provided on one of the ignition coil and the ignition cable.

5. A joint construction as claimed in claim 1, further comprising:

a retainer which is slidably fitted into the electrical conductor and is brought into contact with the boss of the ring so as to radially expand the ring such that the ring is held in a state where the ring projects out of the insulating sleeve through contact of an end face of the ring with an end face of the insulating sleeve;

wherein when the high-voltage terminal is depressed, together with the retainer, into the electrical conductor in said state of the ring, the retainer regulates the ring to such a position that until the boss of the ring is brought into engagement with the recess of the high-voltage terminal, the boss of the ring does not interfere with the high-voltage terminal being inserted into the electrical conductor;

wherein when the boss of the ring has been brought into engagement with the recess of the high-voltage terminal, the retainer is disengaged from the boss of the ring so as to set the ring to such a dimension that the ring can be fitted into the insulating sleeve.

6. A joint construction as claimed in claim 5, further comprising:

a stopper for positioning and holding the retainer disengaged from the boss of the ring, which is provided on an inner periphery of the electrical conductor.

7. A joint construction as claimed in claim 5, further comprising:

an engageable portion and a mating engageable portion engageable with the engageable portion, for holding the electrical conductor at a position where the electrical conductor projects from the end face of the insulating sleeve, which are, respectively, formed on an outer periphery of the electrical conductor and an inner periphery of the insulating sleeve so as to not only regulate further projection of the electrical conductor from the insulating sleeve but allow displacement of the electrical conductor relative to the insulating sleeve in a direction opposite to that of projection of the electrical conductor from the insulating sleeve.

8. A joint construction as claimed in claim 6, further comprising:

an engageable portion and a mating engageable portion engageable with the engageable portion, for holding the electrical conductor at a position where the electrical conductor projects from the end face of the insulating sleeve, which are, respectively, formed on an inner periphery of the insulating sleeve so as to not only regulate further projection of the electrical conductor from the insulating sleeve but allow displacement of the electrical conductor relative to the insulating sleeve in a direction opposite to that of projection of the electrical conductor from the insulating sleeve.

* * * * *

UNITED STATES PATENT AND TRADEMARK OFFICE

CERTIFICATE OF CORRECTION

PATENT NO. : 5,547,387

DATED : August 20, 1996

INVENTOR(S) : Yoshinao KOBAYASHI

It is certified that error appears in the above-indentified patent and that said Letters Patent is hereby corrected as shown below:

On the cover, in section [56], "References Cited", "FOREIGN PATENT DOCUMENTS", column 2, line 4, change "2/1984" to ---2/1994---.

On the cover, in section [56], "References Cited", "OTHER DOCUMENTS", insert ---English Language Abstract of JP -- 6-33863 --.

At column 14, line 16,(claim 8, line 8), after "formed on an" insert ---outer periphery of the electrical conductor and an---.

Signed and Sealed this

First Day of April, 1997

Bruce Lehman

BRUCE LEHMAN

*Commissioner of Patents and Trademarks*

*Attest:*

*Attesting Officer*